US010173443B2

(12) United States Patent
Hamada

(10) Patent No.: US 10,173,443 B2
(45) Date of Patent: Jan. 8, 2019

(54) MEDIUM SUPPORT UNIT, RECORDING DEVICE, AND MEDIUM SUPPORT METHOD

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/525,001

(22) PCT Filed: Nov. 11, 2015

(86) PCT No.: PCT/JP2015/005622
§ 371 (c)(1),
(2) Date: May 5, 2017

(87) PCT Pub. No.: WO2016/079952
PCT Pub. Date: May 26, 2016

(65) Prior Publication Data
US 2018/0117930 A1 May 3, 2018

(51) Int. Cl.
*B41J 11/06* (2006.01)
*B41J 11/20* (2006.01)

(52) U.S. Cl.
CPC ..... *B41J 11/20* (2013.01); *B41J 11/06* (2013.01)

(58) Field of Classification Search
CPC . B41J 11/20; B41J 11/06; B41J 25/304; B41J 25/308; B41J 25/3082; B41J 25/3084; B41J 25/3086; B41J 25/3088; B41J 25/312; B41J 25/316
See application file for complete search history.

(56) References Cited

U.S. PATENT DOCUMENTS

| | | | |
|---|---|---|---|
| 7,413,301 | B2 | 8/2008 | Niimi et al. |
| 7,765,927 | B1 | 8/2010 | Liu et al. |
| 8,177,442 | B2 | 5/2012 | Abbott et al. |
| 8,256,889 | B1 | 9/2012 | Abbott et al. |
| 2013/0057632 | A1 | 3/2013 | Moriya et al. |
| 2014/0375740 | A1 | 12/2014 | Moriya et al. |
| 2015/0197103 | A1 | 7/2015 | Moriya et al. |

FOREIGN PATENT DOCUMENTS

| | | |
|---|---|---|
| JP | 2007-031888 | 2/2007 |
| JP | 2013-063637 | 4/2013 |

OTHER PUBLICATIONS

International Search Report dated Mar. 23, 2016 for PCT/JP2015/005622.

*Primary Examiner* — Kristal Feggins
(74) *Attorney, Agent, or Firm* — Workman Nydegger

(57) ABSTRACT

A medium support unit (2) include a support surface (7) that can support a medium, a depressed portion (11) in which a part of the medium supported by the support surface (7) can be depressed with respect to the support surface (7), and an adjustment unit (8) which can change a size of the depressed portion (11) by changing a state of a first area in the depressed portion (11). By such a configuration, it is possible to suppress a rise of the medium supported by the support surface (7) according to size and shape of a thick part of the medium including the thick part.

13 Claims, 9 Drawing Sheets

[Fig. 1]
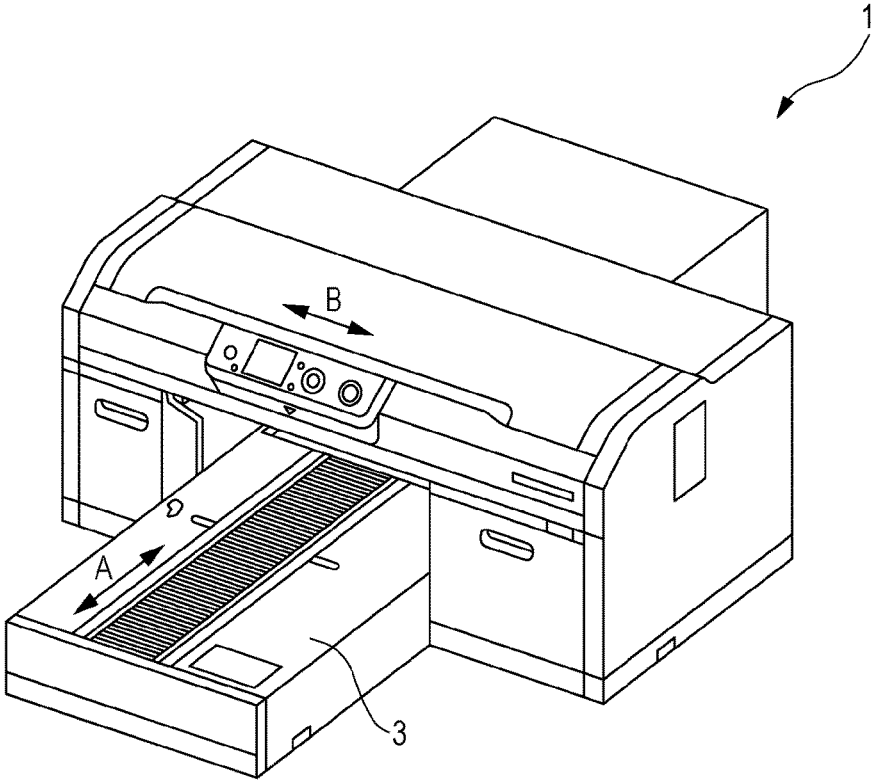

[Fig. 2]
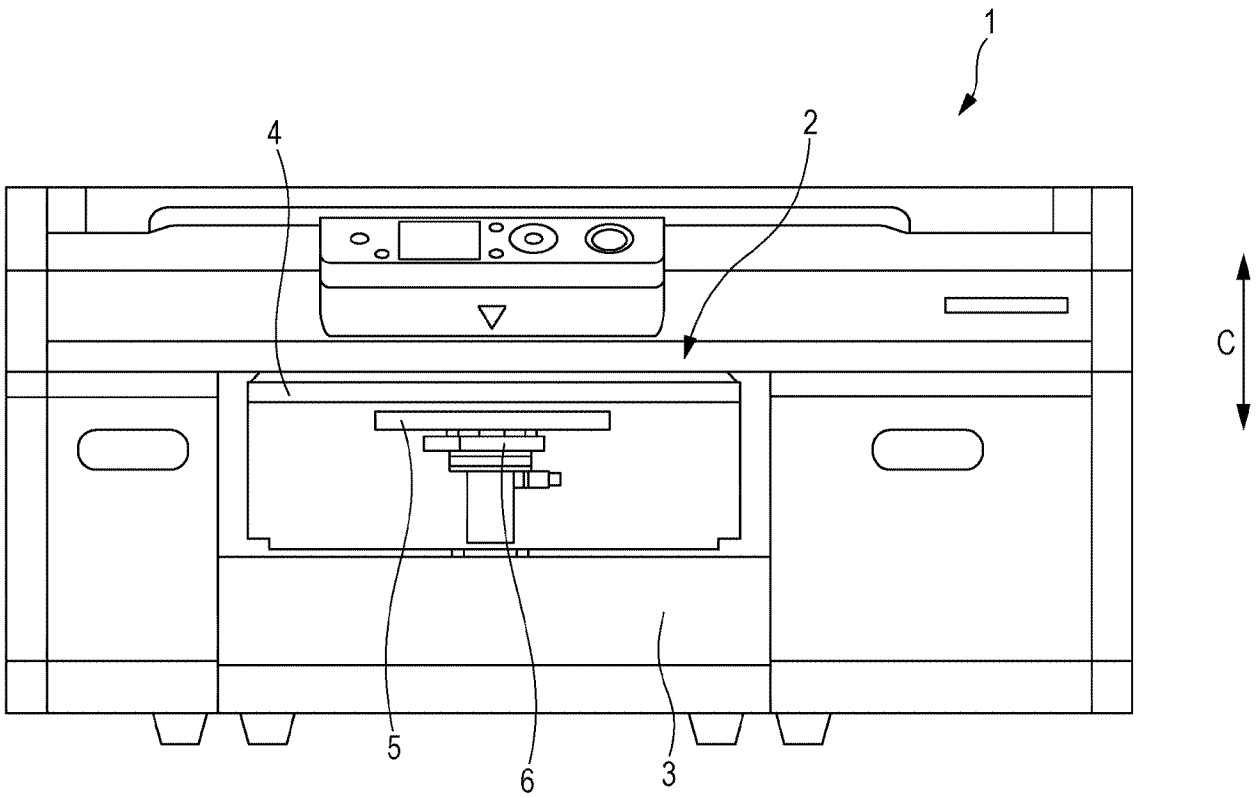

[Fig. 3]
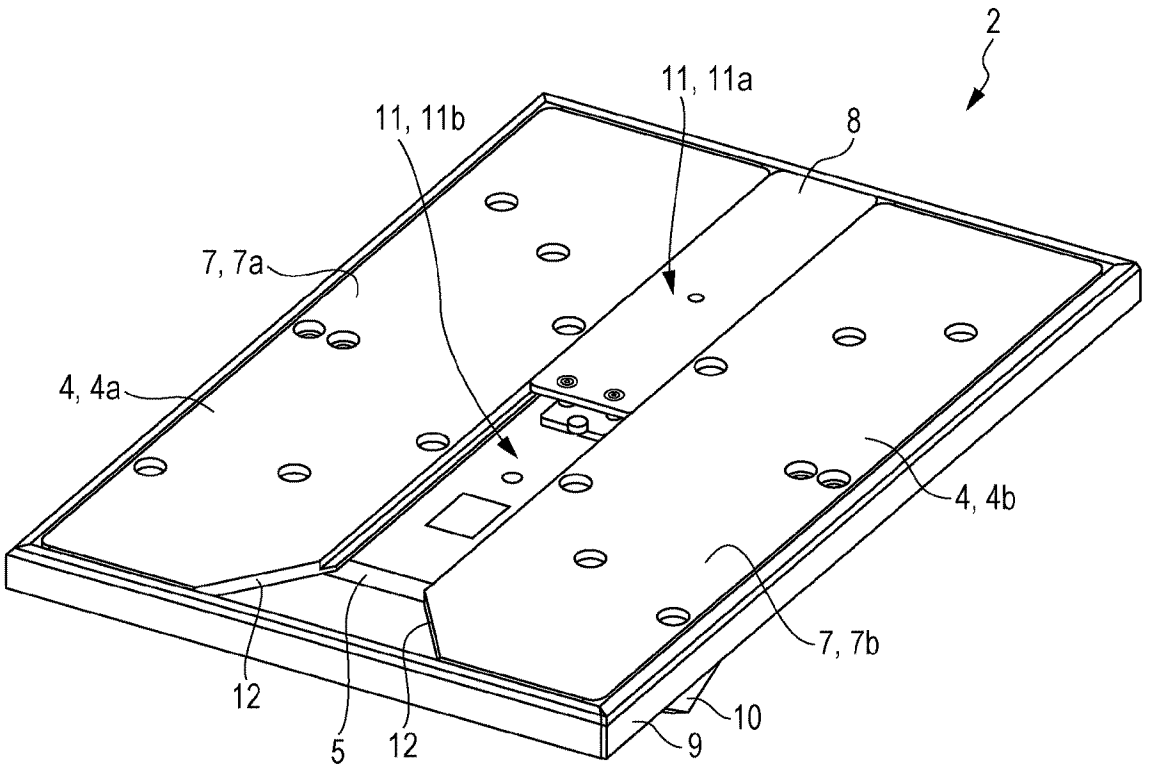

[Fig. 4]
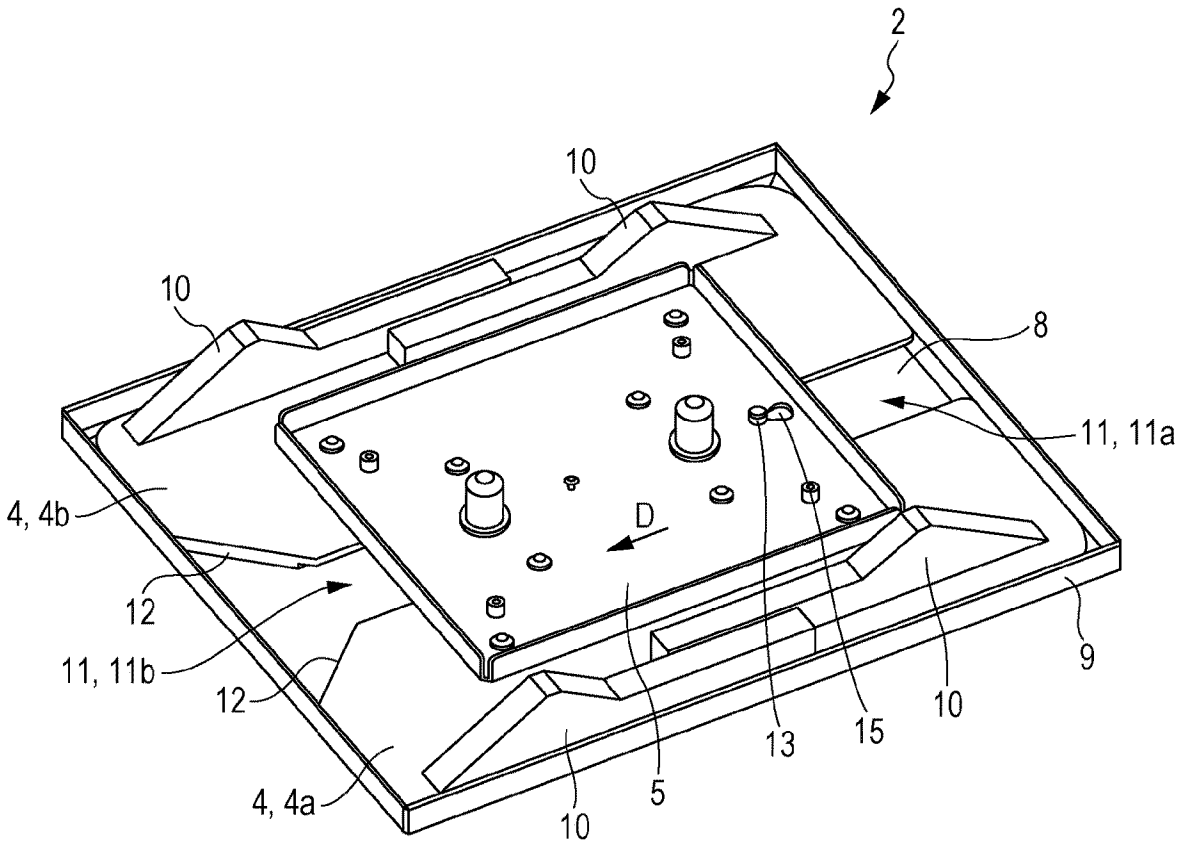

[Fig. 5]
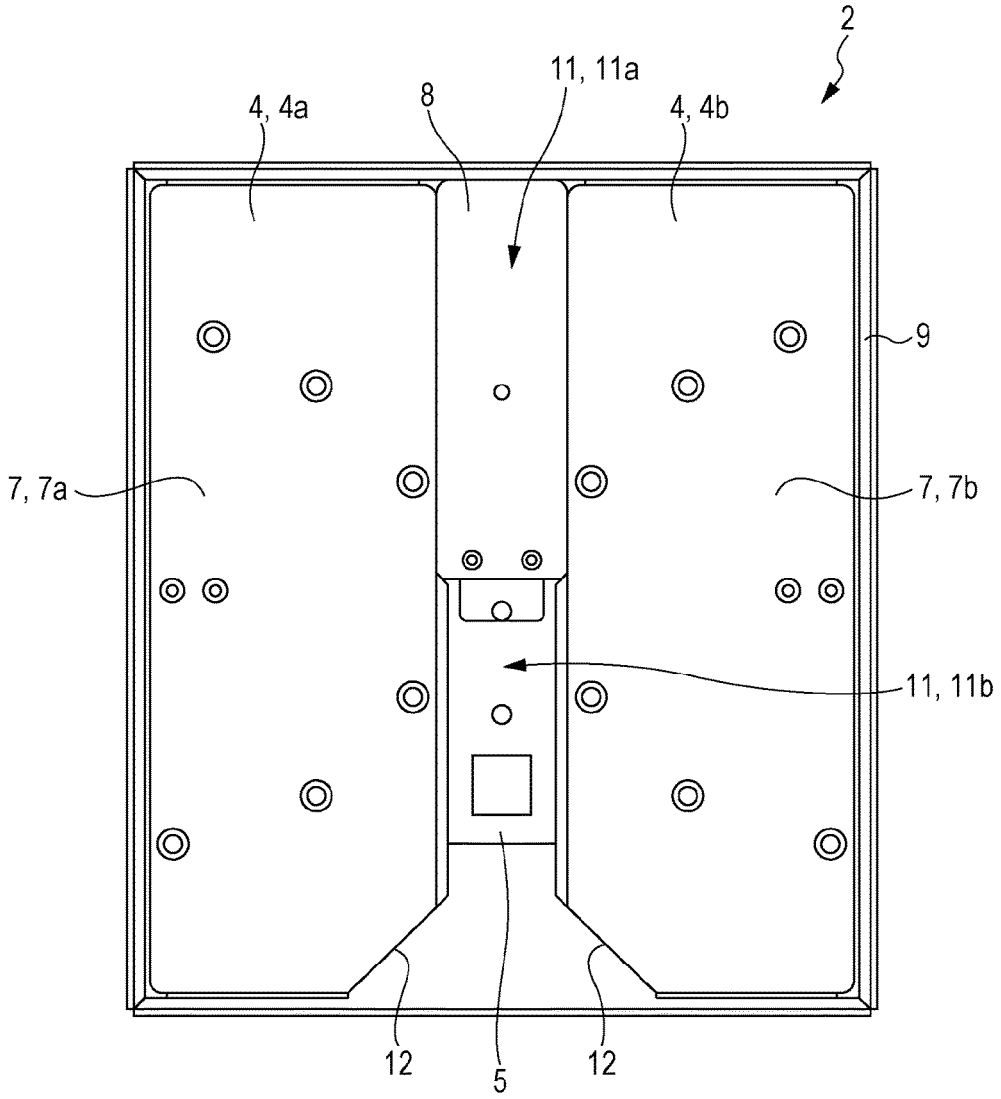

[Fig. 6]
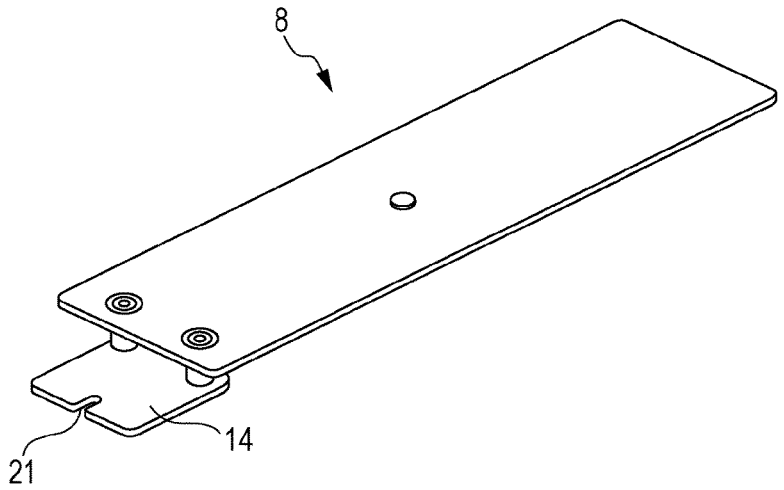
[Fig. 7]
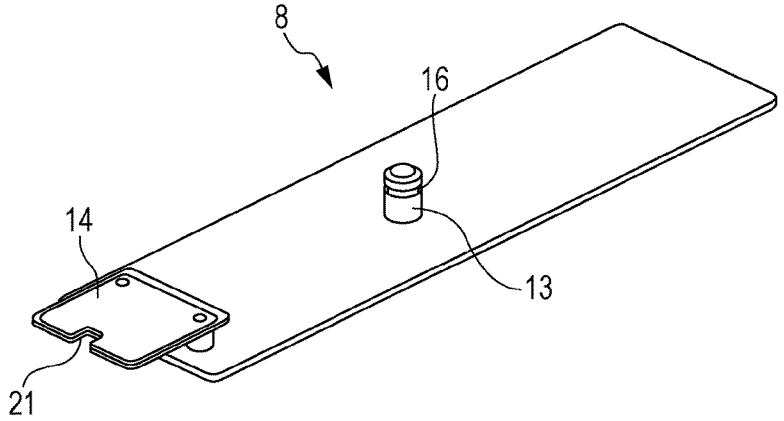
[Fig. 8]
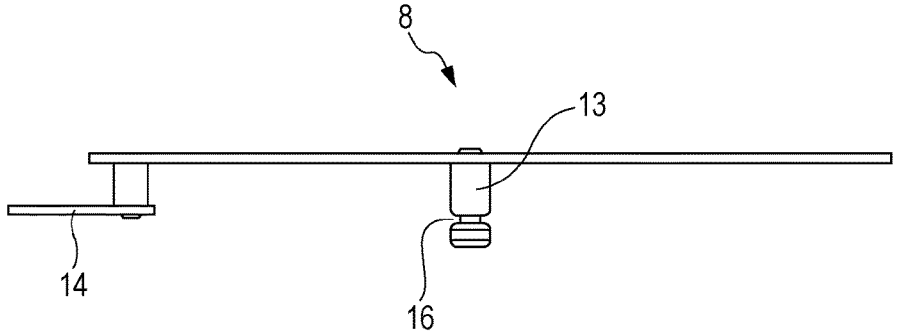

[Fig. 9]
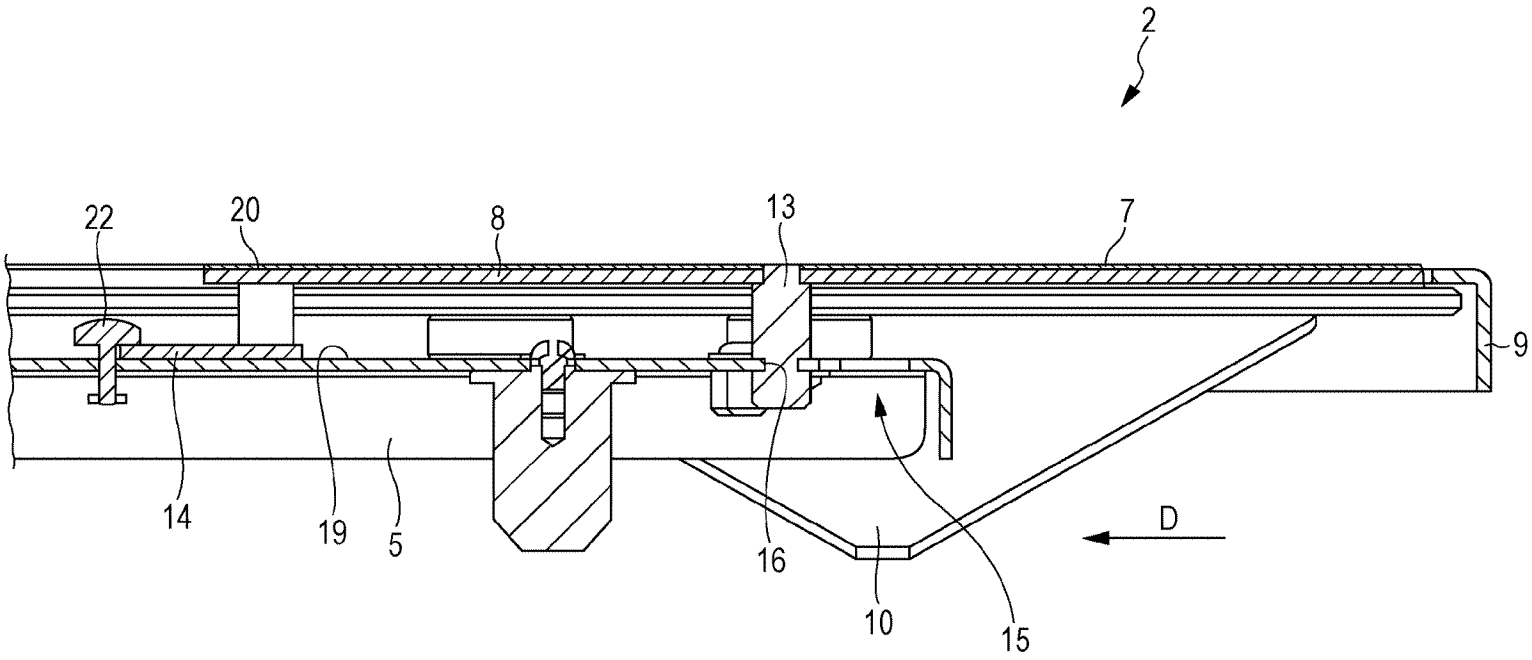

[Fig. 10]
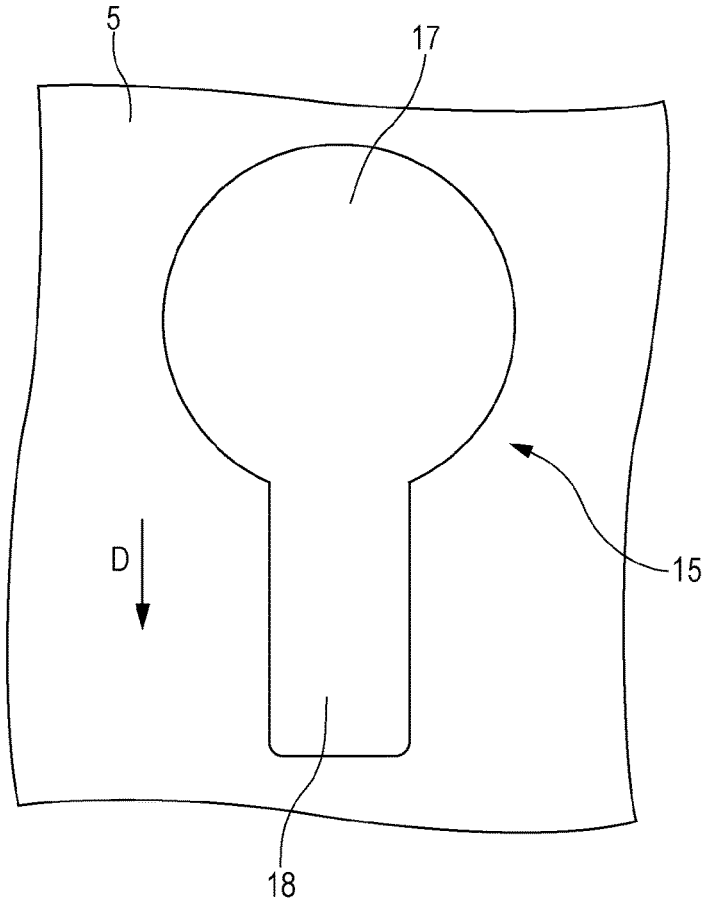

[Fig. 11]
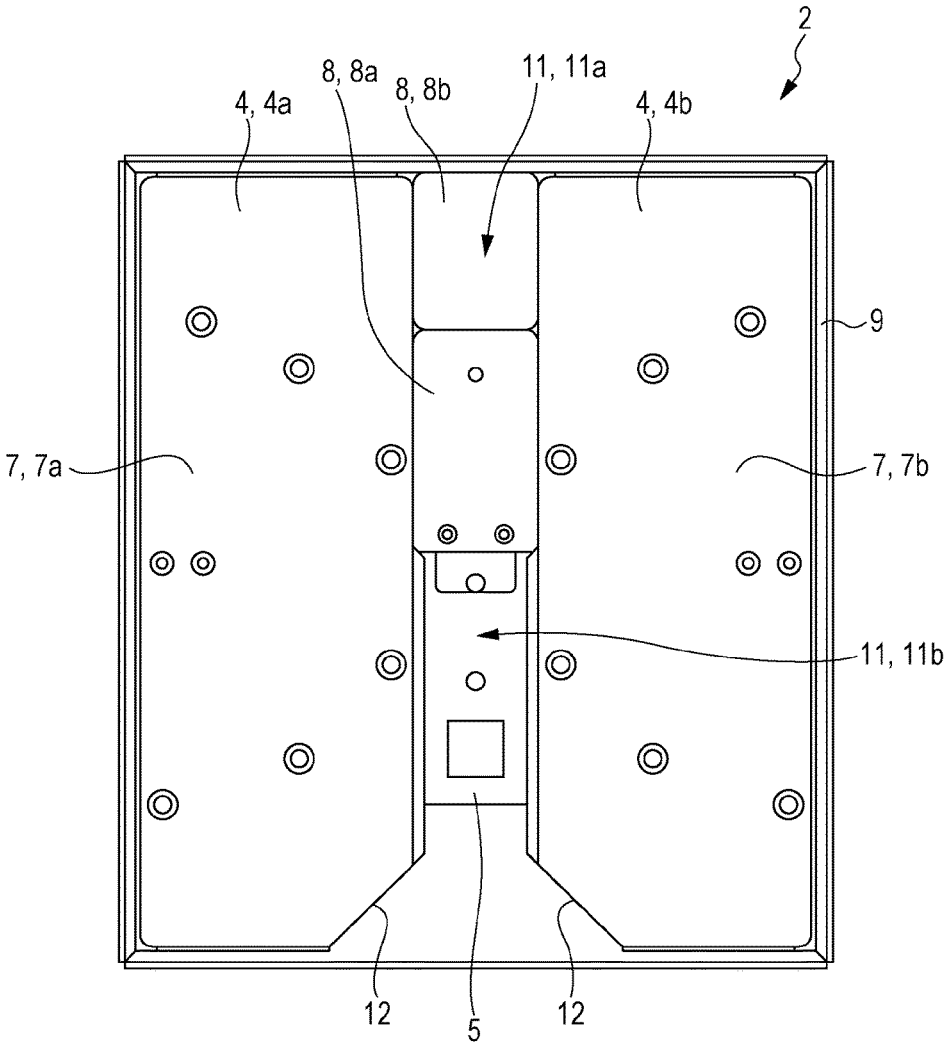

MEDIUM SUPPORT UNIT, RECORDING DEVICE, AND MEDIUM SUPPORT METHOD

The entire disclosure of Japanese Patent Application No. 2014-232582 filed Nov. 17, 2014, is expressly incorporated by reference herein.

TECHNICAL FIELD

The present invention relates to a medium support unit, a recording device, and a medium support method.

BACKGROUND ART

Conventionally, a medium support unit that supports a medium has been used.

For example, PTL 1 discloses a recording device including a medium support unit having a plate where a T-shirt or the like can be set.

CITATION LIST

Patent Literature

PTL 1: JP-A-2013-63637

SUMMARY OF INVENTION

Technical Problem

Here, a garment such as a T-shirt has a thick part such as a part where a pocket or a button is included and a folded part of cloth. Therefore, in a recording device or the like which includes a medium support unit that can support a garment as a medium, if such a thick part is directly mounted on a support surface, the thick part rises and, for example, there is a risk that the thick part comes into contact with a recording unit or the like of the recording device.

Therefore, the recording device of PTL 1 includes a recessed portion corresponding to such a thick part in the plate to be able to reduce the risk that the thick part comes into contact with the recording unit or the like.

On the other hand, in recent years, it is requested to perform recording or the like on media such as garments of various shapes, so that it is requested to handle various sizes and shapes of thick parts.

Accordingly, it is an object of the present invention to suppress a rise of the medium supported by the support surface according to the size and shape of the thick part of the medium including the thick part.

Solution to Problem

A medium support unit of a first aspect of the invention is characterized by including a support surface that can support a medium, a depressed portion in which a part of the medium supported by the support surface can be depressed with respect to the support surface, and an adjustment unit which can change a size of the depressed portion by changing a state of a first area in the depressed portion.

A medium support unit of a second aspect of the invention is characterized in that the depressed portion includes the first area where a state can be changed by the adjustment unit and a second area where a state cannot be changed by the adjustment unit.

In the second aspect, a medium support unit of a third aspect of the invention is characterized in that the first area and the second area are continuously formed in the depressed portion.

In any one of the first to the third aspects, a medium support unit of a fourth aspect of the invention is characterized in that the support surface includes a first support surface and a second support surface that is away from the first support surface, and the depressed portion is formed between the first support surface and the second support surface.

In any one of the first to the fourth aspects, a medium support unit of a fifth aspect of the invention is characterized in that the adjustment unit can easily change the size of the depressed portion to a plurality of sizes.

In the fifth aspect, a medium support unit of a sixth aspect of the invention is characterized in that the adjustment unit includes a first adjustment unit and a second adjustment unit.

In the sixth aspect, a medium support unit of a seventh aspect of the invention is characterized in that at least sizes or shapes of the first adjustment unit and the second adjustment unit are different from each other.

In any one of the first to the seventh aspects, a medium support unit of an eighth aspect of the invention is characterized in that the size of the depressed portion can be changed by attaching or removing the adjustment unit to or from the depressed portion.

In any one of the first to the seventh aspects, a medium support unit of a ninth aspect of the invention is characterized in that the size of the depressed portion can be changed by changing a position of the adjustment unit with respect to the depressed portion.

In any one of the first to the ninth aspects, a medium support unit of a tenth aspect of the invention is characterized in that at least a part of the depressed portion is bottomless.

In any one of the first to the ninth aspects, a medium support unit of an eleventh aspect of the invention is characterized in that at least a part of the depressed portion has a bottom portion.

In any one of the first to the eleventh aspects, a medium support unit of a twelfth aspect of the invention is characterized in that the depressed portion is formed to be able to depress a thick part of a garment when the medium is the garment.

A recording device of a thirteenth aspect of the invention is characterized by including the medium support unit of any one of the first to the twelfth aspects and a recording unit that can perform recording on the medium supported by the medium support unit.

A medium support method of a fourteenth aspect of the invention is a medium support method of a medium support unit including a support surface that can support a medium and a depressed portion in which a part of the medium supported by the support surface can be depressed with respect to the support surface. The medium support method is characterized by including the step of adjusting a size of the depressed portion by adjusting a size of a first area in the depressed portion according to the medium.

Advantageous Effects of Invention

According to the present invention, it is possible to suppress a rise of the medium supported by the support surface according to the size and shape of the thick part of the medium including the thick part.

BRIEF DESCRIPTION OF DRAWINGS

FIG. 1 is a schematic perspective view of a recording device according to a first embodiment of the invention.

FIG. 2 is a schematic front view of the recording device according to the first embodiment of the invention.

FIG. 3 is a schematic perspective view of a medium support unit according to the first embodiment of the invention.

FIG. 4 is a schematic perspective view of the medium support unit according to the first embodiment of the invention.

FIG. 5 is a schematic plan view of the medium support unit according to the first embodiment of the invention.

FIG. 6 is a schematic perspective view of a main part of the medium support unit according to the first embodiment of the invention.

FIG. 7 is a schematic perspective view of the main part of the medium support unit according to the first embodiment of the invention.

FIG. 8 is a schematic side view of the main part of the medium support unit according to the first embodiment of the invention.

FIG. 9 is a schematic side cross-sectional view of the medium support unit according to the first embodiment of the invention.

FIG. 10 is a schematic plan view of a main part of the medium support unit according to the first embodiment of the invention.

FIG. 11 is a schematic plan view of a medium support unit according to a second embodiment of the invention.

DESCRIPTION OF EMBODIMENTS

Hereinafter, a recording device according to embodiments of the invention will be described in detail with reference to the attached drawings.

The embodiments below are described using a recording device including a medium support unit. However, the medium support unit of the invention is not limited to a medium support unit included in a recording device.

The embodiments below are described using an ink jet recording device, which performs recording by discharging ink from a recording head, as the recording device. However, the recording device of the invention is not limited to an ink jet recording device.

[First Embodiment] (FIGS. 1 to 10)

First, a recording device according to a first embodiment of the invention will be described.

FIG. 1 is a schematic perspective view of a recording device 1 according to the first embodiment of the invention. FIG. 2 is a schematic front view of the recording device according to the first embodiment of the invention.

The recording device 1 of the present embodiment includes a medium transport unit 3 that transports a medium supported by a tray 4, which is a medium support unit in the medium support unit 2, in a transport direction A. The tray 4 is fixed in a state in which the tray 4 is mounted on a stage 5. The tray 4 moves along with the stage 5 in a height direction C by rotating a rotation lever 6.

A recording head (not shown in the drawings), which is a recording unit, is provided inside a main body of the recording device 1. The recording device 1 of the present embodiment forms a desired image by discharging ink from the recording head to the medium supported by the tray 4 while reciprocating the recording head, which is the recording unit, in a scanning direction B crossing the transport direction A. In the recording device 1 of the present embodiment, a front portion (a lower left portion) in FIG. 1 is a setting position of the medium onto the tray 4 and the recording is performed while the tray 4 is moving toward the front in FIG. 1 after the tray 4 where the medium is set is moved to a recording start position at a rear portion (an upper right portion) in FIG. 1.

Next, the medium support unit 2, which is a main part of the recording device 1 of the present embodiment, will be described.

FIG. 3 is a schematic perspective view of the medium support unit 2 of the present embodiment as seen from a diagonally upward position. FIG. 4 is a schematic perspective view of the medium support unit 2 of the present embodiment as seen from a diagonally downward position. FIG. 5 is a schematic plan view of the medium support unit 2 according to the present embodiment.

The medium support unit 2 of the present embodiment can be attached to and removed from the recording device 1. The medium support unit 2 includes the tray 4 having a support surface 7 that can support a medium. In other words, the medium support unit 2 includes the support surface 7 that can support a medium. Further, the medium support unit 2 includes the stage 5 where the tray 4 is mounted, an adjustment unit 8 that can adjust a support area of the medium, an outer frame portion 9 that suppresses the medium supported by the support surface 7 at an outer edge portion, and a leg portions 10 which are setting portions used when the medium support unit 2 is removed from the recording device 1.

Further, the medium support unit 2 of the present embodiment includes a depressed portion 11 in which a part of the medium supported by the support surface 7 can be depressed with respect to the support surface 7. It is possible to adjust the size of the depressed portion 11 by attaching or removing the adjustment unit 8. A phrase that the size of the depressed portion 11 "can be adjusted" can be rephrased into a phase that the size of the depressed portion 11 "can be changed" to a desired size. More specifically, it is possible to change the size of the depressed portion 11 by changing a state of a first area 11*a* in the depressed portion 11 by attaching or removing the adjustment unit 8. The state of the first area 11*a* can be changed to a closed state in which a medium can be supported by the adjustment unit 8 and an open state in which the medium can be depressed. In summary, the medium support unit 2 includes the adjustment unit 8 which can change the size of the depressed portion 11 by changing the state of the first area 11*a* in the depressed portion 11.

Therefore, it is possible to suppress the rise of the medium supported by the support surface according to the size and shape of the thick part of the medium including the thick part.

The "thick part" means a part which is thicker than the other parts of the medium. For example, when the medium is a garment, the thick part corresponds to a collar part, a pocket part, a button part, a zipper part, a part where fabrics are overlapped (a connection portion between garment bodies and a folded part of pants), and the like.

The depressed portion 11 in the medium support unit 2 of the present embodiment includes the first area 11*a* where a state can be changed by the adjustment unit 8 and a second area 11*b* where a state cannot be changed by the adjustment unit 8. In other words, the state of the first area 11*a* can be changed to the open state and the closed state, and the second area 11*b* is in the open state at all times. That is, the depressed portion 11 includes the second area 11*b* where a part of a medium can be depressed with respect to the support surface 7. Therefore, when the medium support unit 2 of the present embodiment supports a medium such as a polo shirt, whose shape is limited to some extent, it is possible to adjust a support position of the medium and a recording position when recording is performed on the medium by setting a thick part of the medium into the second area 11*b*.

The tray 4 of the present embodiment is provided with a cut portion 12 so that a collar or the like of a shirt or a polo shirt can be saved downward (so that a rise can be suppressed).

The first area 11*a* and the second area 11*b* are continuously formed, so that it is possible to handle a continuous large thick part by making the first area 11*a* be able to cause the medium to be depressed continuously from the second area 11*b* that can depress the medium at all times.

For example, when using a polo shirt whose thick part is small, it is possible to cause the medium support unit 2 to support the polo shirt by attaching the adjustment unit 8 to reduce the area of the depressed portion 11, and when using a shirt whose thick part is large, it is possible to cause the medium support unit 2 to support the shirt by removing the adjustment unit 8 to increase the area of the depressed portion 11.

The tray 4 of the present embodiment includes a first tray 4*a* and a second tray 4*b* and the support surface 7 includes a first support surface 7*a* provided to the first tray 4*a* and a second support surface 7*b* provided to the second tray 4*b*. The first support surface 7*a* and the second support surface 7*b* are provided to be away from each other and the depressed portion 11 is formed between the first support surface 7*a* and the second support surface 7*b*.

By such a configuration, the depressed portion 11 of the present embodiment is largely formed between the first support surface 7*a* and the second support surface 7*b* to be able to handle a continuous large thick part such as a part where buttons are formed on a shirt. For example, it is possible to handle even a medium including a thick portion, which vertically divides the medium, such as a full zip type fastener by removing the adjustment unit 8 and using the two support surfaces (the first support surface 7*a* and the second support surface 7*b*) away from each other. Regarding a medium including a thick portion, which does not vertically divide the medium, such as a half zip type fastener, it is possible to support the medium by three support surfaces (the first support surface 7*a*, the second support surface 7*b*, and the adjustment unit 8) in a state in which the adjustment unit 8 is attached.

As described above, the medium support unit 2 of the present embodiment can support a garment as a medium and the depressed portion 11 is formed to be able to depress a thick part of the garment when the medium is the garment. Therefore, even when a garment including a thick part such as a collar, a button, a zipper, a pocket, and a part where fabric is folded is used as a medium, the medium support unit 2 can suppress a rise of the medium corresponding to the thick part.

In the medium support unit 2 of the present embodiment, the depressed portion 11 is a space that does not have a bottom portion. Therefore, it is possible to handle a medium having a thick part thicker than a thick part of a medium handled by a medium support unit 2 in which a part of the support surface 7 is made thinner than the other surface to form the adjustment unit 8. However, it is possible to make a part of the support surface 7 thinner than the other surface to form the adjustment unit 8. In this case, the thin part of the support surface 7 becomes the bottom portion.

While the depressed portion 11 may be bottomless or may have a bottom, if at least a part of the depressed portion 11 is bottomless, it is possible to suppress a rise of the medium supported by the support surface 7 regardless of the size of the thickness of the thick part of the medium.

On the other hand, when at least a part of the depressed portion 11 has a bottom portion, the thick part of the medium can be supported by the bottom portion, so that it is possible to improve stability of supporting the medium.

Next, the adjustment unit 8 where the size of the depressed portion 11 can be adjusted will be described in detail.

FIGS. 6 and 7 are schematic perspective views of the adjustment unit 8 removed from the medium support unit 2. FIG. 6 is a view of the adjustment unit 8 as seen from a diagonally upward position. FIG. 7 is a view of the adjustment unit 8 as seen from a diagonally downward position. FIG. 8 is a schematic side view of the adjustment unit 8 removed from the medium support unit 2. FIG. 9 is a schematic side cross-sectional view of the medium support unit 2 in a state in which the adjustment unit 8 is attached to the medium support unit 2. FIG. 10 is a schematic plan view of a portion where the adjustment unit 8 is attached in the medium support unit 2.

As shown in FIGS. 3 to 5 and 9, the adjustment unit 8 of the present embodiment can be attached to the medium support unit 2. Further, as shown in FIGS. 6 to 8, the adjustment unit 8 of the present embodiment can be removed from the medium support unit 2. By this configuration, it is possible to adjust the size of the depressed portion 11 by attaching or removing the adjustment unit 8 of the present embodiment to or from the depressed portion 11 of the medium support unit 2. As described above, the adjustment unit 8 can be attached to and removed from the medium support unit 2, so that it is possible to reduce the weight of the medium support unit 2 by removing the adjustment unit 8 when enlarging the depressed portion 11.

However, the adjustment unit 8 is not limited to the configuration described above. For example, the size of the depressed portion 11 may be made adjustable by changing (moving) the position of the adjustment unit 8 with respect to the depressed portion 11 instead of attaching or removing the adjustment unit 8 to or from the depressed portion 11 of the medium support unit 2. When using the above configuration, the adjustment unit 8 need not be removed when enlarging the depressed portion 11, so that it is not necessary to provide an installation space of the adjustment unit 8. Further, it is possible to reduce the possibility of missing the adjustment unit 8.

As shown in FIGS. 6 to 9, the adjustment unit 8 of the present embodiment includes a mounting portion 14 that can be mounted on a mounting surface 19 (see FIG. 9) provided on the stage 5 and an insertion portion 13, a part of which is inserted into a hole portion 15 (see FIG. 4) provided in the mounting surface 19.

As shown in FIG. 10 showing the hole portion 15 provided in the stage 5, the hole portion 15 is provided with a large-diameter portion 17 into which the insertion portion 13 can be inserted and a small-diameter portion 18 (see FIGS. 7 to 9) into which a small-diameter insertion portion 16 provided to the insertion portion 13 can be fitted.

When the adjustment unit 8 is fixed to the stage 5, as shown in FIGS. 4 and 9, a part of the insertion portion 13 is inserted in the large-diameter portion 17 of the hole portion 15 and is moved in an insertion direction D, so that the small-diameter insertion portion 16 of the insertion portion 13 is fitted into the small-diameter portion 18 of the hole portion 15. Then, a user fixes a fixing portion 21 (see FIGS. 6 and 7) provided to the mounting portion 14 to the stage 5 with a screw 22 (see FIG. 9), so that the adjustment unit 8 is fixed to the stage 5.

The vertical length of the small-diameter insertion portion 16 in FIG. 9 is formed larger than the thickness of a component member of the mounting surface 19 of the stage 5, so that a gap is generated between the small-diameter insertion portion 16 and the component member of the mounting surface 19. Therefore, it is easy to attach the adjustment unit 8 to the medium support unit 2.

As shown in FIG. 9, the adjustment unit 8 is provided with an adjustment surface 20, which becomes a surface of the adjustment unit 8 when the adjustment unit 8 is attached to the medium support unit 2. The adjustment surface 20 becomes a surface that supports a medium when the adjustment unit 8 is attached. So, the adjustment surface 20 can be said to be a third support surface. The adjustment surface 20 is configured to be positioned lower than the support surface 7 of the tray 4 when the adjustment unit 8 is attached to the medium support unit 2. This is to prevent the medium from coming into contact with the recording head in a portion where the medium is held by the adjustment surface 20. Although not limited to the configuration as described above, it is preferable that the adjustment surface 20 is the same level as the support surface 7 or the adjustment surface 20 is positioned at a level lower than the support surface 7.

The attaching method and the fixing method of the adjustment unit 8 are not limited to the attaching method and the fixing method of the adjustment unit 8 to the medium support unit 2 as described in the present embodiment, but it is possible to use an attaching method and a fixing method of the adjustment unit 8 to the medium support unit 2 by using a magnet, a hook and loop fastener, or the like.

[Second Embodiment] (FIG. 11)

Next, a medium support unit 2 according to a second embodiment of the invention will be described. The same components as those in the first embodiment are denoted by the same reference numerals and the detailed description thereof will be omitted.

FIG. 11 is a schematic plan view of the medium support unit 2 according to the second embodiment of the invention.

The medium support unit 2 of the present embodiment has the same configuration as that of the medium support unit 2 of the first embodiment except for the configuration of the adjustment unit 8 where the size of the depressed portion 11 can be adjusted.

As shown in FIG. 11, the adjustment unit 8 of the present embodiment has a first adjustment unit 8*a* and a second adjustment unit 8*b*. In other words, the adjustment unit 8 has a plurality of adjustment units. Therefore, it is possible to easily adjust the size of the depressed portion 11 by using a plurality of adjustment units, which are the first adjustment unit 8*a* and the second adjustment unit 8*b*, so that it is possible to handle various sizes of thick parts.

The adjustment unit 8 of the present embodiment can adjust the size of the depressed portion 11 by using both or one of the first adjustment unit 8*a* and the second adjustment unit 8*b*. Further, it is possible to adjust the size of the depressed portion 11 by using one of the first adjustment unit 8*a* and the second adjustment unit 8*b* whose sizes and shapes are different from each other. The adjustment unit 8 may have three or more adjustment units.

As shown in FIG. 11, in the adjustment unit 8 of the present embodiment, the first adjustment unit 8*a* and the second adjustment unit 8*b* have sizes and shapes different from each other. In this way, when a plurality of adjustment units whose at least sizes and shapes are different from each other are provided, it is possible to easily adjust the size of the depressed portion 11 by, for example, selecting and using one of the first adjustment unit 8*a* and the second adjustment unit 8*b* according to the shape and size of the thick part. However, when there is a plurality of adjustment units, a plurality of adjustment units whose sizes and shapes are the same may be used. Further, it is possible to combine and use the adjustment units whose sizes (areas of a portion that supports the medium) are the same and whose shapes (shapes in plan view of a portion that supports the medium) are different from each other. Further, it is possible to combine and use the adjustment units whose shapes are the same and whose sizes are different from each other. As the shape of the adjustment unit, it is possible to use various shapes such as a polygon, a circle, and a shape corresponding to a design of a certain part of a garment.

The invention is not limited to the above embodiments and various modifications can be made within the scope of the invention described in claims, and needless to say that the modifications are included in the scope of the invention.

The invention has been described based on the specific embodiments. Here, the invention will be collectively described.

The medium support unit 2 of a first aspect of the invention is characterized by including the support surface 7 that can support a medium, the depressed portion 11 in which a part of the medium supported by the support surface 7 can be depressed with respect to the support surface 7, and the adjustment unit 8 which can adjust the size of the depressed portion 11 by changing a state of the first area 11*a* in the depressed portion 11.

According to this aspect, the medium support unit 2 includes the adjustment unit 8 which can adjust the size of the depressed portion 11. Therefore, it is possible to suppress the rise of the medium supported by the support surface 7 according to the size and shape of the thick part of the medium including the thick part.

The "thick part" means a part which is thicker than the other parts of the medium. For example, when the medium is a garment, the thick part corresponds to a part where a pocket or a button is formed and a part where fabric is folded.

The medium support unit 2 of a second aspect of the invention is characterized in that the depressed portion 11 includes the first area 11*a* where a state can be changed by the adjustment unit 8 and a second area 11*b* where a state cannot be changed by the adjustment unit 8.

According to this aspect, the depressed portion 11 includes the second area 11*b* where a state cannot be changed by the adjustment unit 8. In other words, the depressed portion 11 includes the second area 11*b* where a part of a medium can be depressed with respect to the support surface 7. Therefore, when supporting a medium such as a polo shirt, whose shape is limited to some extent, it is possible to adjust a support position of the medium and a recording position when recording is performed on the medium by setting a thick part of the medium into the second area 11*b*.

In the second aspect, the medium support unit 2 of a third aspect of the invention is characterized in that the first area 11*a* and the second area 11*b* are continuously formed in the depressed portion 11.

According to this aspect, the first area 11*a* and the second area 11*b* are continuously formed in the depressed portion 11. Therefore, it is possible to handle a continuous large thick part by making the first area 11*a* be able to cause a medium to be depressed continuously from the second area 11*b* that can depress the medium at all times.

In any one of the first to the third aspects, the medium support unit 2 of a fourth aspect of the invention is characterized in that the support surface 7 includes a first support surface 7*a* and a second support surface 7*b* that is away from the first support surface 7*a*, and the depressed portion 11 is formed between the first support surface 7*a* and the second support surface 7*b*.

According to this aspect, the support surface 7 includes the first support surface 7*a* and the second support surface 7*b*, and depressed portion 11 is formed between the first support surface 7*a* and the second support surface 7*b*. Therefore, it is possible to largely form the depressed portion 11 between the first support surface 7*a* and the second support surface 7*b*, so that it is possible to handle a continuous large thick part.

In any one of the first to the fourth aspects, the medium support unit 2 of a fifth aspect of the invention is characterized in that the adjustment unit 8 can easily change the size of the depressed portion 11 to a plurality of sizes.

According to this aspect, the adjustment unit 8 can easily change the size of the depressed portion 11 to a plurality of sizes. Therefore, it is possible to handle various sizes of thick parts.

In the fifth aspect, the medium support unit 2 of a sixth aspect of the invention is characterized in that the adjustment unit 8 includes a first adjustment unit 8*a* and a second adjustment unit 8*b*.

According to this aspect, the adjustment unit 8 includes the first adjustment unit 8*a* and the second adjustment unit 8*b*. In other words, the adjustment unit 8 includes a plurality of adjustment units 8*a* and 8*b*. Therefore, it is possible to easily adjust the size of the depressed portion 11 into a plurality of sizes by the plurality of adjustment units 8*a* and 8*b*.

It is possible to employ any of a configuration in which the size of the depressed portion 11 is adjusted by using both or one of the first adjustment unit 8*a* and the second adjustment unit 8*b* and a configuration in which the size of the depressed portion 11 is adjusted by selecting and using one of the first adjustment unit 8*a* and the second adjustment unit 8*b* whose sizes and shapes are different from each other.

In the sixth aspect, the medium support unit 2 of a seventh aspect of the invention is characterized in that at least sizes or shapes of the first adjustment unit 8*a* and the second adjustment unit 8*b* are different from each other.

According to this aspect, at least sizes or shapes of the first adjustment unit 8*a* and the second adjustment unit 8*b* are different from each other. Therefore, it is possible to easily adjust the size of the depressed portion 11 to an appropriate size by, for example, selecting and using one of the first adjustment unit 8*a* and the second adjustment unit 8*b* according to the shape and size of the thick part.

In any one of the first to the seventh aspects, the medium support unit 2 of an eighth aspect of the invention is characterized in that the size of the depressed portion 11 can be changed by attaching or removing the adjustment unit 8 to or from the depressed portion 11.

According to this aspect, it is possible to adjust the size of the depressed portion 11 by attaching or removing the adjustment unit 8 to or from the depressed portion 11. Therefore, the adjustment unit 8 can be removed when enlarging the depressed portion 11, so that the weight of the medium support unit 2 can be reduced.

In any one of the first to the seventh aspects, the medium support unit 2 of a ninth aspect of the invention is characterized in that the size of the depressed portion 11 can be changed by changing a position of the adjustment unit 8 with respect to the depressed portion 11.

According to this aspect, it is possible to adjust the size of the depressed portion 11 by changing the position of the adjustment unit 8 with respect to the depressed portion 11. Therefore, the adjustment unit 8 need not be removed when enlarging the depressed portion 11, so that it is not necessary to provide an installation space of the adjustment unit 8 and it is possible to reduce the possibility of missing the adjustment unit 8.

In any one of the first to the ninth aspects, the medium support unit 2 of a tenth aspect of the invention is characterized in that at least a part of the depressed portion 11 is bottomless.

According to this aspect, at least a part of the depressed portion 11 is bottomless. Therefore, it is possible to suppress the rise of the medium supported by the support surface 7 regardless of the size of the thickness of the thick part of the medium.

In any one of the first to the ninth aspects, the medium support unit 2 of an eleventh aspect of the invention is characterized in that at least a part of the depressed portion 11 has a bottom portion.

According to this aspect, at least a part of the depressed portion 11 has a bottom portion. Therefore, the thick part of the medium can be supported, so that it is possible to improve stability of supporting the medium.

In any one of the first to the eleventh aspects, the medium support unit 2 of a twelfth aspect of the invention is characterized in that the depressed portion 11 is formed to be able to depress a thick part of a garment when the medium is the garment.

According to this aspect, the depressed portion 11 is formed to be able to depress a thick part of a garment when the medium is the garment. Therefore, even when a garment including a thick part such as a collar, a button, a zipper, a pocket, and a part where fabric is folded is used as a medium, it is possible to suppress a rise of the medium corresponding to the thick part.

The recording device 1 of a thirteenth aspect of the invention is characterized by including the medium support unit 2 of any one of the first to the twelfth aspects and a recording unit that can perform recording on the medium supported by the medium support unit 2.

According to this aspect, it is possible to suppress the rise of the medium supported by the support surface 7 according to the size and shape of the thick part of the medium including the thick part and to perform recording on the medium where the rise is suppressed.

A medium support method of a fourteenth aspect of the invention is a medium support method of the medium support unit 2 including the support surface 7 that can support a medium and the depressed portion 11 in which a part of the medium supported by the support surface 7 can be depressed with respect to the support surface 7. The medium support method is characterized by including the step of changing a size of the depressed portion 11 by changing a size of the first area 11*a* in the depressed portion 11 according to the medium.

According to this aspect, the size of the depressed portion 11 is changed according to the medium. Therefore, it is possible to suppress the rise of the medium supported by the support surface 7 according to the size and shape of the thick part of the medium including the thick part.

REFERENCE SIGNS LIST

1 Recording device
2 Medium support unit
3 Medium transport unit
4 Tray
5 Stage
6 Rotation lever
7 Support surface
8 Adjustment unit
9 Frame portion
10 Leg portion
11 Depressed portion
12 Cut portion
13 Insertion portion
14 Mounting portion
15 Hole portion
16 Small-diameter insertion portion
17 Large-diameter portion
18 Small-diameter portion
19 Mounting surface
20 Adjustment surface
21 Fixing portion
22 Screw

The invention claimed is:

1. A medium support unit comprising:

a support surface that can support a medium;

a depressed portion in which a part of the medium supported by the support surface can be depressed with respect to the support surface; and an adjustment unit which can change a size of the depressed portion by changing a state of a first area in the depressed portion, wherein the depressed portion includes the first area where a state can be changed by the adjustment unit from a first state where the medium can be supported by the adjustment unit to a second state that is an open state where the part of the medium can be depressed and the depressed portion includes a second area where a state cannot be changed by the adjustment unit such that the second area is in an open.

2. The medium support unit according to claim 1, wherein the first area and the second area are continuously formed in the depressed portion.

3. The medium support unit according to claim 1, wherein the support surface includes a first support surface and a second support surface that is away from the first support surface, and the depressed portion is formed between the first support surface and the second support surface.

4. The medium support unit according to claim 1, wherein the adjustment unit can easily change the size of the depressed portion to a plurality of sizes.

5. The medium support unit according to claim 4, wherein the adjustment unit includes a first adjustment unit and a second adjustment unit.

6. The medium support unit according to claim 5, wherein at least sizes or shapes of the first adjustment unit and the second adjustment unit are different from each other.

7. The medium support unit according to claim 1, wherein the size of the depressed portion can be changed by attaching or removing the adjustment unit to or from the depressed portion.

8. The medium support unit according to claim 1, wherein the size of the depressed portion can be changed by changing a position of the adjustment unit with respect to the depressed portion.

9. The medium support unit according to claim 1, wherein at least a part of the depressed portion is bottomless.

10. The medium support unit according to claim 1, wherein at least a part of the depressed portion has a bottom portion.

11. The medium support unit according to claim 1, wherein the depressed portion is formed to be able to depress a thick part of a garment when the medium is the garment.

12. A recording device comprising:

the medium support unit according to claim 1; and a recording unit that can perform recording on the medium supported by the medium support unit.

13. A medium support method of a medium support unit including a support surface that can support a medium and a depressed portion in which a part of the medium supported by the support surface can be depressed with respect to the support surface, the medium support method comprising the step of:

changing a size of the depressed portion by changing a state of a an adjustment unit in the depressed portion according to the medium, wherein the depressed portion includes the first area where a state can be changed by the adjustment unit from a first state where the medium can be supported by the adjustment unit to a second state that is an open state where the part of the medium can be depressed and the depressed portion includes a second area where a state cannot be changed by the adjustment unit such that the second area is in an open state.

* * * * *